US011857832B2

(12) United States Patent
Mead

(10) Patent No.: US 11,857,832 B2
(45) Date of Patent: Jan. 2, 2024

(54) BODY STRETCHING SYSTEM

(71) Applicant: Michael Mead, Columbus, OH (US)

(72) Inventor: Michael Mead, Columbus, OH (US)

( * ) Notice: Subject to any disclaimer, the term of this patent is extended or adjusted under 35 U.S.C. 154(b) by 0 days.

(21) Appl. No.: 17/562,610

(22) Filed: Dec. 27, 2021

(65) Prior Publication Data

US 2023/0201651 A1 Jun. 29, 2023

(51) Int. Cl.
*A63B 21/00* (2006.01)
*A63B 21/055* (2006.01)
*A63B 21/04* (2006.01)

(52) U.S. Cl.
CPC ..... *A63B 21/4019* (2015.10); *A63B 21/04* (2013.01); *A63B 21/0557* (2013.01); *A63B 21/4011* (2015.10); *A63B 21/4035* (2015.10)

(58) Field of Classification Search
CPC ..... A63B 21/00069; A63B 21/00178; A63B 21/00185; A63B 21/0023; A63B 21/04; A63B 21/0407; A63B 21/151; A63B 21/153; A63B 21/157; A63B 21/4001; A63B 21/4045; A01K 27/004
See application file for complete search history.

(56) References Cited

U.S. PATENT DOCUMENTS 7,621,856 B1 * 11/2009 Keith ..... A63B 23/1218 119/796
8,684,894 B2 * 4/2014 Flynn ..... A63B 21/00061 482/121
9,314,658 B2 * 4/2016 Kaye ..... A63B 23/03508
9,339,678 B2 * 5/2016 Gallagher ..... A61B 5/024
9,731,157 B2 * 8/2017 Loach ..... A63B 21/0053
10,478,662 B2 * 11/2019 Davis ..... A63B 21/4013
2006/0201450 A1 * 9/2006 Jordan ..... A63B 23/04 119/796
2007/0131177 A1 * 6/2007 Perkitny ..... A01K 27/004 119/796
2012/0205479 A1 * 8/2012 Wang ..... A01K 27/004 242/396.4
2017/0014665 A1 * 1/2017 Bowles ..... A63B 21/4013
2017/0259112 A1 * 9/2017 Davis ..... A63B 21/4013
2019/0001175 A1 * 1/2019 Wagner ..... A63B 21/22
2021/0339078 A1 * 11/2021 Akeel ..... A63B 24/0087

* cited by examiner

*Primary Examiner* — Sundhara M Ganesan
*Assistant Examiner* — Zachary T Moore
(74) *Attorney, Agent, or Firm* — The Iwashko Law Firm, PLLC; Lev Ivan Gabriel Iwashko

(57) ABSTRACT

A body stretching system, including a limb stretching unit, including a main body, a gripping structure disposed on at least a portion of the main body to removably connect to a first limb of a user, and a ratchet assembly disposed within at least a portion of the main body and connected to the gripping structure to removably connect to a second limb of the user and/or a stationary object and stretch the first limb away from or towards the second limb and/or the stationary object by increasing a tension level between the first limb and the second limb in response to moving the gripping structure, and a rack assembly removably connected to the limb stretching unit to facilitate stretching.

7 Claims, 3 Drawing Sheets

BODY STRETCHING SYSTEM

BACKGROUND

1. Field

The present general inventive concept relates generally to physical therapy and physical training, and particularly, to a body stretching system.

2. Description of the Related Art

Assisted stretching is a therapeutic treatment offered by rehab centers, physical therapists, and/or doctors for recovering athletes, injured individuals, and/or any other persons experiencing muscle discomfort. Although incredibly beneficial, the treatment is quite expensive and not one that is commonly sought by many. Moreover, to ensure the treatment is actually beneficial, a person seeking relief must get assisted stretching consistently, which not only warrants regular doctor and/or rehab center visits, but also increases expenditure.

While people can perform stretching individually, people are rarely able to push themselves in ways that would achieve results. Thus, the person seeking relief will continue to feel pain and/or discomfort for longer periods of time than could be achieved if proper stretching techniques were achieved.

Therefore, there is a need for a body stretching system that facilitates stretching by the person without assistance by a third party.

SUMMARY

The present general inventive concept provides a body stretching system.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a body stretching system, including a limb stretching unit, including a main body, a gripping structure disposed on at least a portion of the main body to removably connect to a first limb of a user, and a ratchet assembly disposed within at least a portion of the main body and connected to the gripping structure to removably connect to a second limb of the user or stationary object and stretch the first limb away from or towards the second limb or stationary object by increasing a tension level between the first limb and the second limb or stationary object in response to moving the gripping structure, and a rack assembly removably connected to the limb stretching unit to facilitate stretching.

The gripping structure may include a grip body, a handle disposed on at least a portion of the grip body to facilitate gripping thereof, a ratchet actuator disposed on at least a portion of the grip body to stretch the first limb away from or towards the second limb or stationary object in response to moving the ratchet actuator toward the handle, and a plurality of release buttons disposed on at least a portion of the grip body to release the ratchet assembly in response to being depressed.

The ratchet actuator may be spring biased to return to its original position.

The gripping structure may further include a limb strap removably connected to at least a portion of the grip body to removably connect to the first limb of the user, such that the limb of the user remains connected to the grip body after the handle is released.

The ratchet assembly may include a ratchet coil disposed within at least a portion of the main body to rotate in a first direction in response to moving the gripping structure, and rotate in a second direction only in response to being released, and a ratchet strap disposed on at least a portion of the ratchet coil to connect to the second limb of the user.

The ratchet coil may include a sensor and a motor to detect optimal stretching of the user, such that the ratchet coil automatically increases the tension level without actuation by the user.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
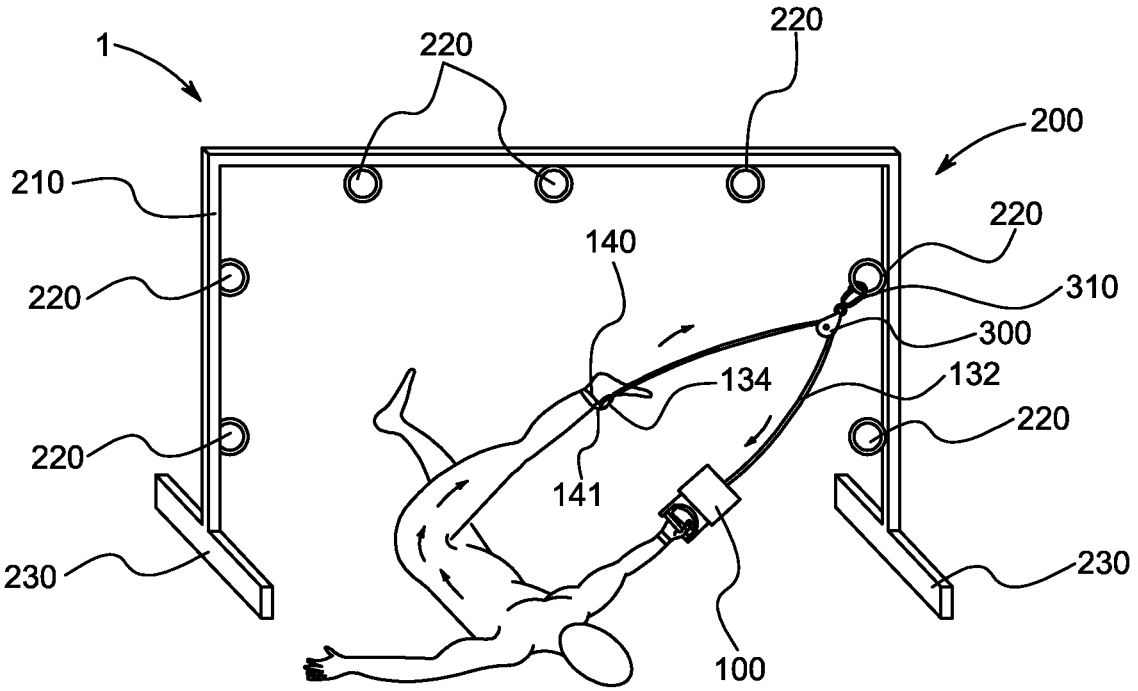
FIG. 1 illustrates a side perspective view of a body stretching system, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Body Stretching System 1
Limb Stretching Unit 100
Main Body 110
Strap Aperture 111
Gripping Structure 120
Grip Body 121
First Arm 121*a*
Second Arm 121*b*
Handle 122
Ratchet Actuator 123
Release Buttons 124
Limb Strap 125
Connection Straps 126
Strap Connectors 127
Strap Fasteners 128
Ratchet Assembly 130
Ratchet Coil 131
Ratchet Strap 132
Ring Connector 133
Ring Fastener 134
Limb Attachment 140
Limb Ring 141
Rack Assembly 200
Rack Body 210
Rings 220
Base 230
Pulley 300
Pulley Ring 310
Limb Stretching Unit 400
Main Body 410
Strap Aperture 411
Gripping Structure 420
Grip Body 421
Handle 422
Ratchet Actuator 423
Release Buttons 424
Limb Strap 425
Strap Connector 426
Ratchet Assembly 430
Ratchet Coil 431
Ratchet Strap 432
Ring Connector 433
Ring Fastener 434

FIG. 1 illustrates a side perspective view of a body stretching system 1, according to an exemplary embodiment of the present general inventive concept.

Figure 2:
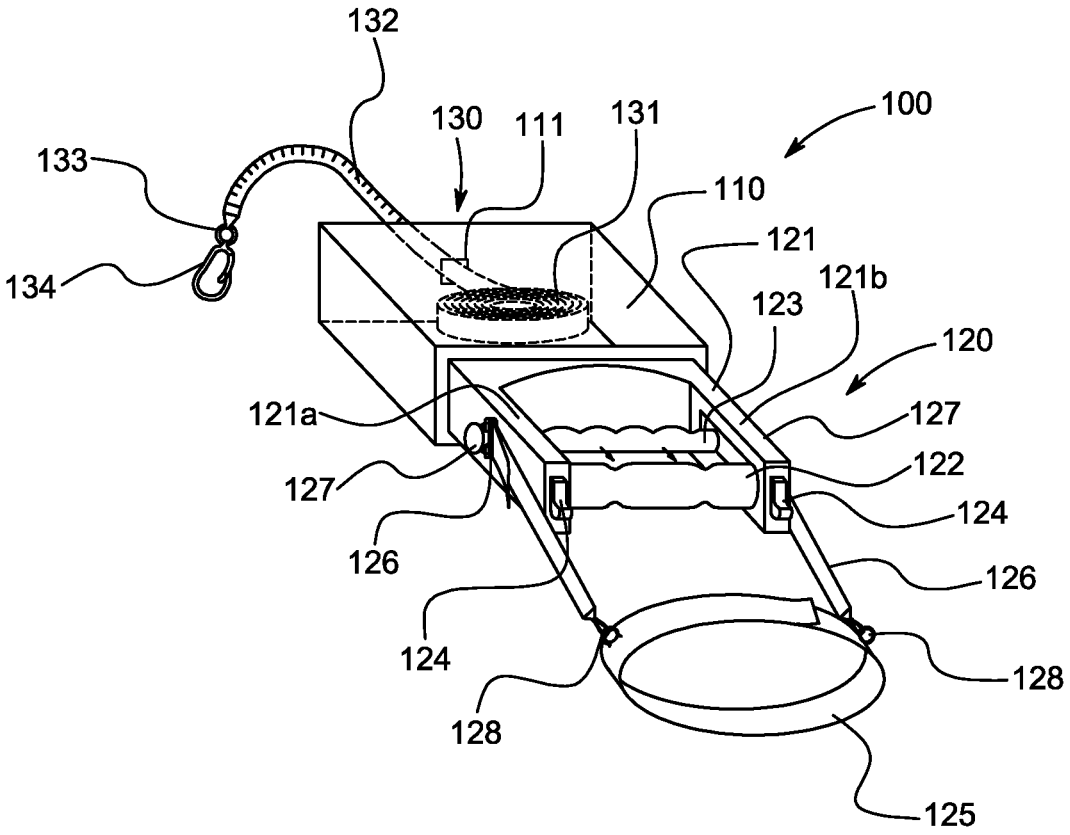
FIG. 2 illustrates an isometric top view of a limb stretching unit, according to an exemplary embodiment of the present general inventive concept.

FIG. 2 illustrates an isometric top view of a limb stretching unit 100, according to an exemplary embodiment of the present general inventive concept.

The body stretching system 1 may be constructed from at least one of metal, plastic, wood, and rubber, etc., but is not limited thereto.

The body stretching system 1 may include a limb stretching unit 100, a rack assembly 200, and a pulley 300, but is not limited thereto.

The limb stretching unit 100 may include a main body 110, a gripping structure 120, a ratchet assembly 130, and at least one limb attachment 140, but is not limited thereto.

Referring to FIG. 2, the main body 110 is illustrated to have a rectangular prism shape. However, the main body 110 may be rectangular, circular, conical, triangular, pentagonal, hexagonal, heptagonal, octagonal, or any other shape known to one of ordinary skill in the art, but is not limited thereto.

The main body 110 may include a strap aperture 111, but is not limited thereto.

The strap aperture 111 may facilitate movement of a strap in or out of the main body 110.

The gripping structure 120 may include a grip body 121, a handle 122, a ratchet actuator 123, a plurality of release buttons 124, a limb strap 125, a plurality of connection straps 126, a plurality of strap connectors 127, and a plurality of strap fasteners 128, but is not limited thereto.

The grip body 121 may be disposed on at least a portion of the main body 110. More specifically, the grip body 121 may be perpendicularly disposed away from an edge of the main body 110 with respect to a direction. Moreover, the grip body 121 may have a U-shape, such that a first arm 121*a* and a second arm 121*b* of the grip body 121 extend away from the main body 110.

The handle 122 may be disposed on at least a portion of the grip body 121 between the first arm 121*a* and the second arm 121*b*. The handle 122 may facilitate gripping thereof.

The ratchet actuator 123 may be movably (i.e. slidably) disposed on at least a portion of the grip body 121, within grooves of the grip body 121, between the first arm 121*a* and the second arm 121*b*, and distanced from the handle 122. The ratchet actuator 123 may move from an original position (e.g., away from the handle 122) to at least partially toward the handle 122 in response to an application of force (e.g., squeezing, pushing, pulling) thereto. Conversely, the ratchet actuator 123 may move from the handle 122 toward the original position based on a spring bias (e.g., a spring) that resets the ratchet actuator 123 to the original position.

Each of the plurality of release buttons 124 may be disposed on at least a portion of the first arm 121*a*, the second arm 121*b*, the handle 122, and/or the ratchet actuator 123. In other words, at least one of the plurality of release buttons 124 may be disposed on at least a portion of the first arm 121*a* and/or the second arm 121*b*. Also, each of the plurality of release buttons 124 may operate by toggle and/or holding down by the user for as long as needed.

The limb strap 125 may be removably connected to at least a portion of the grip body 121 and/or the main body 110. The limb strap 125 may be removably connected via a fastener (e.g., a hook and loop faster, an adhesive) to a limb of a user, such as a wrist, an arm, an ankle, and/or a leg. As such, the limb strap 125 may secure the limb of the user therein, while connected to the limb.

The plurality of connection straps 126 may be removably connected to at least a portion of the grip body 121 and/or the main body 110. More specifically, each of the plurality of connection straps 126 may connect at a first end to at least a portion of the limb strap 125 to connect the limb strap 125 to the grip body 121.

Each of the plurality of strap connectors 127 may receive and/or connect to at least one of a second end of the plurality of connection straps 126. In other words, each of the plurality of connections straps 126 may removably connect at the second end to at least one of the plurality of strap connectors 127, such that the plurality of strap connectors 127 may prevent the plurality of connection straps 126 from falling off the grip body 121 and/or the main body 110.

Referring again to FIG. 2, each of the plurality of strap fasteners 128 are illustrated to be a carabiner. However, each of the plurality of strap fasteners 128 may be a clamp, a clasp, an adhesive (e.g., tape, glue), a magnet, and/or any combination thereof, but is not limited thereto.

The plurality of strap fasteners 128 may removably connect the first end of each of the plurality of connection straps 126 to the limb strap 125.

The ratchet assembly 130 may include a ratchet coil 131, a ratchet strap 132, a ring connector 133, and a ring fastener 134, but is not limited thereto.

The ratchet coil 131 may include a wheel with angled teeth to connect to a cog connected to the ratchet actuator 123. Additionally, the ratchet coil 131 may be movably (i.e. rotatably) disposed within at least a portion of the main body 110. Thus, the ratchet coil 131 may rotate in a first direction (i.e., clockwise) or a second direction (i.e., counterclockwise) in response to the ratchet actuator 123 being moved (e.g., squeezed). However, the ratchet coil 131 may be prevented from moving in the second direction or the first direction due to the cog. In other words, the ratchet coil 131 may operate as a ratchet that rotates in only one direction until released.

Alternatively, the ratchet coil 131 may include a sensor, a motor, and a power source (e.g., a battery) to detect optimal stretching of the user, such that the ratchet coil 131 may automatically increase a tension level without actuation by the user.

Furthermore, the ratchet coil 131 may release in response to depressing at least one of the plurality of release buttons 124. More specifically, the ratchet coil 131 may be spring biased to recoil.

The ratchet strap 132 may be disposed at a first end on at least a portion of the ratchet coil 131 and extend through the strap aperture 111. Thus, the ratchet strap 132 may retract within the main body 131 in response to the ratchet actuator 123 being moved. However, the ratchet strap 132 may loosen and be extended in response to depressing at least one of the plurality of release buttons 124.

The ring connector 133 may be disposed on at least a portion of a second end of the ratchet strap 132.

Referring again to FIG. 2, the ring fastener 134 is illustrated to be a carabiner. However, the ring fastener 134 may be a clamp, a clasp, an adhesive (e.g., tape, glue), a magnet, and/or any combination thereof, but is not limited thereto.

The ring fastener 134 may removably connect to an attachment.

The limb attachment 140 may be constructed as a strap, a belt, and a door jamb knob, but is not limited thereto.

The limb attachment 140 may include a limb ring 141, but is not limited thereto.

The limb attachment 140 may be removably connected to at least a portion of the ring fastener 134. The limb attachment 140 may be removably connected via a fastener (e.g., a hook and loop faster, an adhesive) to the limb of the user. As such, the limb attachment 140 may secure the limb of the user therein, while connected to the limb.

The limb ring 141 may be disposed on at least a portion of the limb attachment 140. The limb ring 141 may connect the limb attachment 140 to the ring fastener 134.

The rack assembly 200 may include a rack body 210, a plurality of rings 220, and a base 230, but is not limited thereto.

The rack body 210 may be highly durable, similar to a squat rack, a weight rack, and/or any other type of rack used for exercising. The rack body 210 may be connected to at least a portion of a surface, such as a wall. Alternatively, the rack body 210 may be disposed on at least a portion of a ground surface, such that the rack body 210 stands on the ground surface. The rack body 210 may support other exercises thereon, such as a pull-up.

Each of the plurality of rings 220 may be another attachment point and/or inflection point, such as hooks.

Each of the plurality of rings 220 may be disposed on at least a portion of the rack body 210 and distanced from each other.

The base 230 may be disposed on at least a portion of the rack body 210 to support the rack body 210 on the ground surface.

The pulley 300 may include a pulley ring 310, but is not limited thereto.

The pulley 300 may be removably connected to the rack body 210 using the pulley ring 310. Moreover, the pulley 300 may be removably connected to the limb stretching unit 100, such as the ratchet strap 132. In other words, the ratchet strap 132 may be threaded through the pulley 300.

During use, the limb strap 132 may be connected to a first limb of the user and the limb attachment 140 may be connected to a second limb of the user based on which limbs and parts of a body of the user, the user intends to stretch. Subsequently, the user may squeeze the ratchet actuator 123 to retract and/or tighten the ratchet strap 132, such that the ratchet strap 132 increases the tension level on the first limb, the second limb, and/or the body of the user. More specifically, the ratchet coil 131 may stretch the first limb away from and/or towards the second limb, the rack assembly 200, and/or other stationary object by increasing the tension level between the first limb and/or the second limb in response to squeezing the ratchet actuator 123. Alternatively, the ratchet strap 132 may increase the tension level in response to depressing a tension button disposed on the main body 110. The ratchet actuator 123 and/or the handle 122 may be released to maintain stretching without use of hands. At least one of the plurality of release buttons 124 may be depressed to loosen and/or decrease the tension level, such that the user may detach the limb strap 132 and/or the limb attachment 140.

Therefore, the body stretching system 1 may facilitate stretching by the user without assistance from another person. Additionally, the body stretching system 1 may increase flexibility of the user, such as for diving and/or gymnastics. Also, the body stretching system 1 may improve recovery for the user without requiring significant time and/or cost.

Figure 3:
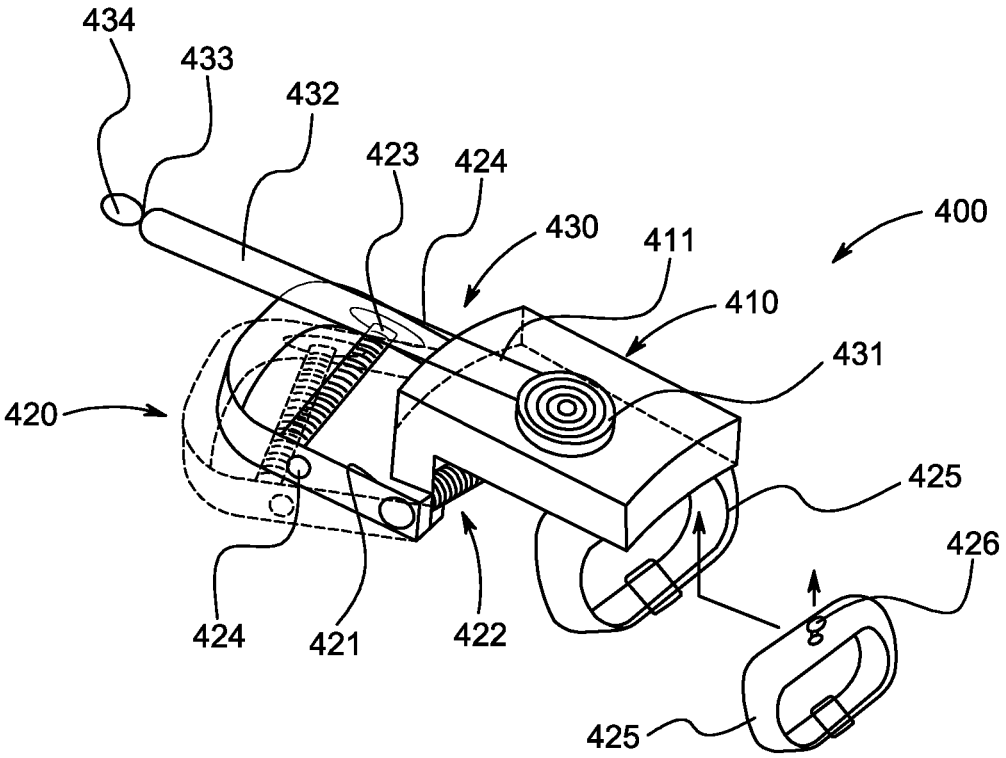
FIG. 3 illustrates an isometric top view of a limb stretching unit, according to another exemplary embodiment of the present general inventive concept.

FIG. 3 illustrates an isometric top view of a limb stretching unit 400, according to another exemplary embodiment of the present general inventive concept.

The limb stretching unit 400 may include a main body 410, a gripping structure 420, and a ratchet assembly 430, but is not limited thereto.

Referring to FIG. 3, the main body 410 is illustrated to have a rectangular prism shape. However, the main body 410 may be rectangular, circular, conical, triangular, pentagonal, hexagonal, heptagonal, octagonal, or any other shape known to one of ordinary skill in the art, but is not limited thereto.

The main body 410 may include a strap aperture 411, but is not limited thereto.

The strap aperture 411 may facilitate movement of a strap in or out of the main body 410.

The gripping structure 420 may include a grip body 421, a handle 422, a ratchet actuator 423, a plurality of release buttons 424, a limb strap 425, and at least one strap connector 426, but is not limited thereto.

The grip body 421 may be movably (i.e., pivotally, rotatably) disposed on at least a portion of the main body 410 via a hinge. More specifically, the grip body 421 may be perpendicularly disposed away from an edge of the main body 410 with respect to a direction. The grip body 421 may pivot in a first rotational direction or a second rotational direction opposite with respect to the first rotational direction. For example, the grip body 421 may pivot at least forty-five degrees. As such, the ratchet actuator 423 may be gripped from different positions. Moreover, the grip body 421 may have a U-shape.

The handle 422 may be disposed on at least a portion of the grip body 421 and/or the main body 110. The handle 422 may facilitate gripping thereof.

The ratchet actuator 423 may be movably (i.e. slidably) disposed on at least a portion of the grip body 421, within grooves of the grip body 421, and distanced from the handle 422. The ratchet actuator 423 may move from an original position (e.g., away from the handle 422) to at least partially toward the handle 422 in response to an application of force (e.g., squeezing, pushing, pulling) thereto. Conversely, the ratchet actuator 423 may move from the handle 422 toward the original position based on a spring bias (e.g., a spring) that resets the ratchet actuator 423 to the original position.

Each of the plurality of release buttons 424 may be disposed on at least a portion of the grip body 421, the handle 422, and/or the ratchet actuator 423. Also, each of the plurality of release buttons 424 may operate by toggle and/or holding down by the user for as long as needed.

The limb strap 425 may be removably connected to at least a portion of the grip body 421 and/or the main body 410. The limb strap 425 may be removably connected via a fastener (e.g., a hook and loop faster, an adhesive) to a limb of a user, such as a wrist, an arm, an ankle, and/or a leg. As such, the limb strap 425 may secure the limb of the user therein, while connected to the limb.

The at least one strap connector 426 may be inserted into and/or connect to an aperture within the main body 410. In other words, the at least one strap connector 426 may removably connect to the main body 410, such that the at least one strap connector 426 may prevent the limb strap 425 from falling off the grip body 421 and/or the main body 410.

The ratchet assembly 430 may include a ratchet coil 431, a ratchet strap 432, a ring connector 433, and a ring fastener 434, but is not limited thereto.

The ratchet coil 431 may include a wheel with angled teeth to connect to a cog connected to the ratchet actuator 423. Additionally, the ratchet coil 431 may be movably (i.e. rotatably) disposed within at least a portion of the main body 410. Thus, the ratchet coil 431 may rotate in a first direction (i.e., clockwise) or a second direction (i.e., counterclockwise) in response to the ratchet actuator 423 being moved (e.g., squeezed). However, the ratchet coil 431 may be prevented from moving in the second direction or the first direction due to the cog. In other words, the ratchet coil 431 may operate as a ratchet that rotates in only one direction until released.

Alternatively, the ratchet coil 431 may include a sensor, a motor, and a power source (e.g., a battery) to detect optimal stretching of the user, such that the ratchet coil 431 may automatically increase a tension level without actuation by the user.

Furthermore, the ratchet coil 431 may release in response to depressing at least one of the plurality of release buttons 424. More specifically, the ratchet coil 431 may be spring biased to recoil.

The ratchet strap 432 may be disposed at a first end on at least a portion of the ratchet coil 431 and extend through the strap aperture 411. Thus, the ratchet strap 432 may retract within the main body 431 in response to the ratchet actuator 423 being moved. However, the ratchet strap 432 may loosen and be extended in response to depressing at least one of the plurality of release buttons 424.

The ring connector 433 may be disposed on at least a portion of a second end of the ratchet strap 432.

Referring again to FIG. 3, the ring fastener 434 is illustrated to be a carabiner. However, the ring fastener 434 may be a clamp, a clasp, an adhesive (e.g., tape, glue), a magnet, and/or any combination thereof, but is not limited thereto.

The ring fastener 434 may removably connect to an attachment.

It is important to note that the limb stretching unit 400 may replace and/or be used instead of the limb stretching unit 100 based on a preference of the user.

The present general inventive concept may include a body stretching system 1, including a limb stretching unit 100, including a main body 110, a gripping structure 120 disposed on at least a portion of the main body 110 to removably connect to a first limb of a user, and a ratchet assembly 130 disposed within at least a portion of the main body 110 and connected to the gripping structure 120 to removably connect to a second limb of the user and stretch the first limb away from the second limb by increasing a tension level between the first limb and the second limb in response to moving the gripping structure 120, and a rack assembly 130 removably connected to the limb stretching unit to facilitate stretching.

The gripping structure 120 may include a grip body 121, a handle 122 disposed on at least a portion of the grip body 121 to facilitate gripping thereof, a ratchet actuator 123 disposed on at least a portion of the grip body 121 to stretch the first limb away from the second limb in response to moving the ratchet actuator 123 toward the handle 122, and a plurality of release buttons 124 disposed on at least a portion of the grip body 121 to release the ratchet assembly 130 in response to being depressed.

The ratchet actuator 123 may be spring biased to return to its original position.

The gripping structure 120 may further include a limb strap 125 removably connected to at least a portion of the grip body 121 to removably connect to the first limb of the user, such that the limb of the user remains connected to the grip body 121 after the handle 122 is released.

The ratchet assembly 130 may include a ratchet coil 131 disposed within at least a portion of the main body 110 to rotate in a first direction in response to moving the gripping structure 120, and rotate in a second direction only in response to being released, and a ratchet strap 132 disposed on at least a portion of the ratchet coil 131 to connect to the second limb of the user.

The ratchet coil 131 may include a sensor and a motor to detect optimal stretching of the user, such that the ratchet coil automatically increases the tension level without actuation by the user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A body stretching system, comprising:

a limb stretching unit, comprising:

a main body, a gripping structure disposed on at least a first portion of the main body configured to removably connect to a first limb of a user, and a ratchet assembly disposed within at least a second portion of the main body and connected to the gripping structure configured to removably connect to a second limb of the user and stretch the first limb away from the second limb by increasing a tension level between the first limb and the second limb in response to moving a movable portion of the gripping structure, such that moving the movable portion increases the tension level by retracting a portion of the ratchet assembly into the main body, such that the movable portion moves between a first arm and a second arm of the gripping structure; and a rack assembly removably connected to the limb stretching unit to facilitate stretching.

2. The body stretching system of claim 1, wherein the gripping structure comprises:

a grip body;

a handle disposed on at least a portion of the grip body to facilitate gripping thereof;

wherein the movable portion is a ratchet actuator disposed on at least a first portion of the grip body configured to stretch the first limb away from the second limb in response to moving the ratchet actuator toward the handle; and a plurality of release buttons disposed on at least a second portion of the grip body to release the ratchet assembly in response to being depressed.

3. The body stretching system of claim 2, wherein the ratchet actuator is spring biased to return to an original position.

4. The body stretching system of claim 2, wherein the gripping structure further comprises:

a limb strap removably connected to at least a third portion of the grip body configured to removably connect to the first limb of the user, configured such that the first limb of the user remains connected to the grip body after the handle is released.

5. The body stretching system of claim 1, wherein the ratchet assembly comprises:

a ratchet coil disposed within at least a third portion of the main body to rotate in a first direction in response to moving the gripping structure, and rotate in a second direction only in response to being released; and a ratchet strap disposed on at least a portion of the ratchet coil configured to connect to at least one of the second limb of the user and a stationary object.

6. The body stretching system of claim 5, wherein the ratchet coil comprises a sensor and a motor to detect optimal stretching of the user, such that the ratchet coil automatically increases the tension level without actuation by the user.

7. A body stretching system, comprising:

a limb stretching unit, comprising:

a main body, a gripping structure, comprising:

gripping thereof, a grip body having a first arm and a second arm, a handle disposed between the first arm and the second arm to facilitate a ratchet actuator disposed between the first arm and the second arm, and a limb strap removably connected to an outer surface of the first arm and an outer surface of the second arm configured to removably connect to a first limb of the user, configured such that the first limb of the user remains connected to the grip body after the handle is released, and a ratchet assembly disposed within at least a portion of the main body and connected to the gripping structure to removably connect to a second limb of the user and increase a tension level between the first limb and the second limb in response to moving the ratchet actuator toward the handle; and a rack assembly removably connected to the limb stretching unit to facilitate stretching.

* * * * *